US009938847B2

(12) United States Patent
Li et al.

(10) Patent No.: US 9,938,847 B2
(45) Date of Patent: *Apr. 10, 2018

(54) TURBINE ARRANGEMENT WITH IMPROVED SEALING EFFECT AT A SEAL

(71) Applicant: Siemens Aktiengesellschaft, Munich (DE)

(72) Inventors: Yan Sheng Li, North Hykeham (GB); Roy Teuber, Hartmannsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 288 days.

This patent is subject to a terminal disclaimer.

(21) Appl. No.: 14/758,236

(22) PCT Filed: Oct. 23, 2013

(86) PCT No.: PCT/EP2013/072194

§ 371 (c)(1),
(2) Date: Jun. 28, 2015

(87) PCT Pub. No.: WO2014/114372

PCT Pub. Date: Jul. 31, 2014

(65) Prior Publication Data

US 2015/0354391 A1 Dec. 10, 2015

(30) Foreign Application Priority Data

Jan. 28, 2013 (EP) ..... 13152856

(51) Int. Cl.
*F01D 11/02* (2006.01)
*F01D 11/08* (2006.01)
(Continued)

(52) U.S. Cl.
CPC ..... *F01D 11/08* (2013.01); *F01D 11/001* (2013.01); *F01D 25/24* (2013.01); *F05D 2240/80* (2013.01)

(58) Field of Classification Search
CPC ..... F01D 11/08; F01D 11/001; F01D 25/24; F01D 9/065; F01D 11/00; F01D 11/02;
(Continued)

(56) References Cited

U.S. PATENT DOCUMENTS 4,218,189 A * 8/1980 Pask ..... F01D 5/225 277/420
4,265,590 A * 5/1981 Davies ..... F01D 5/081 415/110
(Continued)

FOREIGN PATENT DOCUMENTS

EP 1731717 A2 * 12/2006 ..... F01D 5/085
EP 1731718 A2 * 12/2006 ..... F01D 5/082
(Continued)

OTHER PUBLICATIONS

JP Decision of Grant dated Jul. 4, 2016, for JP application No. 2015-554067.
(Continued)

*Primary Examiner* — Kenneth Bomberg
*Assistant Examiner* — Brian Delrue
(74) *Attorney, Agent, or Firm* — Beusse Wolter Sanks & Maire

(57) ABSTRACT

A turbine arrangement and a gas turbine engine including a rim seal is configured with two cavities. The main fluid path, the two cavities, and a disc space are furthermore separated from another, but still in fluid communication with another, via three annular seal passages. The turbine arrangement also includes a plurality of cooling fluid injectors arranged underneath a radially inner vane platform. The rim seal is configured for an upstream guide vane and a downstream rotor blade.

12 Claims, 6 Drawing Sheets

(51) Int. Cl.
*F01D 25/24* (2006.01)
*F01D 11/00* (2006.01)

(58) Field of Classification Search
CPC ..... F01D 11/04; F01D 11/06; F05D 2240/80; F05D 2240/122
USPC ..... 415/174.3, 173.7
See application file for complete search history.

(56) References Cited

U.S. PATENT DOCUMENTS 4,447,190 A 5/1984 Campbell
5,222,742 A * 6/1993 Roberts ..... F01D 11/02 277/420
5,236,302 A * 8/1993 Weisgerber ..... F01D 5/06 415/173.7
5,503,528 A 4/1996 Glezer et al.
7,430,802 B2 * 10/2008 Tiemann ..... F01D 5/3015 29/889.22
7,534,088 B1 * 5/2009 Alvanos ..... F01D 5/081 415/115
7,540,709 B1 6/2009 Ebert
8,038,399 B1 * 10/2011 Liang ..... F01D 5/082 415/230
8,075,256 B2 12/2011 Little
8,926,283 B2 * 1/2015 Lee ..... F01D 5/145 415/168.4
2004/0265118 A1 * 12/2004 Naik ..... F01D 5/145 415/116
2006/0275107 A1 12/2006 Alvanos et al.
2007/0059158 A1 3/2007 Alvanos et al.
2008/0056889 A1 3/2008 Cheng et al.
2008/0145208 A1 * 6/2008 Klasing ..... F01D 5/082 415/173.7
2008/0145216 A1 * 6/2008 Klasing ..... F01D 5/143 415/208.2
2009/0238683 A1 * 9/2009 Alvanos ..... F01D 11/001 415/173.7
2010/0183426 A1 7/2010 Liang
2011/0150640 A1 * 6/2011 Tiemann ..... F01D 5/3015 415/191
2012/0034072 A1 * 2/2012 Bagnall ..... F01D 11/001 415/170.1
2013/0156598 A1 * 6/2013 Davis ..... F01D 5/082 416/96 R
2013/0189073 A1 * 7/2013 Adaickalasamy .... F01D 11/122 415/1
2013/0224014 A1 * 8/2013 Aggarwala ..... F01D 5/143 415/220
2014/0205443 A1 * 7/2014 Lee ..... F01D 11/001 415/170.1
2015/0010385 A1 * 1/2015 Oyarbide ..... F01D 25/12 415/115
2016/0153304 A1 * 6/2016 Aggarwala ..... F01D 11/001 416/185
2016/0186664 A1 * 6/2016 Kirtley ..... F02C 7/28 415/115
2016/0186665 A1 * 6/2016 Johnson ..... F01D 11/001 415/168.2
2016/0312631 A1 * 10/2016 Bergman ..... F01D 11/001
2016/0341055 A1 * 11/2016 Jenkins ..... F01D 11/001
2017/0044909 A1 * 2/2017 Riazantsev ..... F01D 5/187
2017/0081958 A1 * 3/2017 Xu ..... F01D 5/187

FOREIGN PATENT DOCUMENTS

EP 1939397 A2 7/2008
JP 2006342797 A 12/2006
JP 2007077983 A 3/2007
JP 2008151138 A 7/2008
JP 2010001840 A 1/2010
JP 2010077869 A 4/2010
JP 11006446 A 1/2011
WO WO 2015050676 A1 * 4/2015 ..... F01D 5/082

OTHER PUBLICATIONS

RU Office Action dated Aug. 31, 2017, for RU patent application No. 2015136552.
Ishlinsky A I, Polytechnic Dictionary, "Large Russian Encyclopedia" 2000, p. 581, Moscow RU, 2000.

* cited by examiner

TURBINE ARRANGEMENT WITH IMPROVED SEALING EFFECT AT A SEAL

CROSS REFERENCE TO RELATED APPLICATIONS

This application is the US National Stage of International Application No. PCT/EP2013/072194 filed Oct. 23, 2013, and claims the benefit thereof. The International application claims the benefit of European Application No. EP13152856 filed Jan. 28, 2013. All of the applications are incorporated by reference herein in their entirety.

FIELD OF THE INVENTION

The invention relates to a turbine arrangement with improved sealing effect at a seal.

BACKGROUND OF THE INVENTION

In a gas turbine engine, hot gas are routed from a combustor to a turbine section, in which stator vanes are designed to direct hot combustion gases onto rotor blades resulting in a rotational movement of a rotor to which the rotor blades are connected. Radially inwards and outwards of aerofoils of these stator vanes and rotor blades, platforms, a casing, or other components may be present such as to form an annular fluid passage into which the aerofoils of the stator vanes and the rotor blades extend and through which hot combustion gases are led.

As rotating parts—rows of rotor blades—and non-rotating part—rows of stator vanes—are arranged alternately, gaps may be present between the rows of rotor blades and the rows of stator vanes. It is a goal to reduce the size of the gaps and/or to seal these gaps such that no or little of the mainstream fluid is lost via these gaps. The structure to seal these gaps between rotor blades and stator vanes may be called rim seal.

Patents and patent applications EP 1 731 717 A2, EP 1 731 718 A2, EP 1 939 397 A2, U.S. Pat. No. 7,452,182 B2, and US 2008/0145216 A1 show different kind of seals, that will keep the hot mainstream fluid within the annular fluid passage, possibly without leakage of hot fluid into the cavities of the rim seal and possibly also without egress of cooling fluid via the rim seal into the mainstream. A small gap may be present between the stator vanes and the rotor blades through which, also depending on tolerances, heat expansion of turbine parts and pressure differences of the involved fluids, the mainstream fluid may leak through the seal leaving the mainstream fluid path. It may also happen that a second source of fluid—possibly air provided anyhow for cooling the rotor blades—may leak through the seal in the opposite direction entering the mainstream fluid path. Both types of ingress or egress of fluid and/or air may even happen at different modes of operation for the same seal or may even happen at different circumferential positions in the mainstream fluid path.

Thus, it is a goal of aspects of the invention to provide a modified turbine arrangement that results in minimal ingress and egress of fluid via the seal to/from the mainstream fluid path in most modes of operation, e.g. resulting in less aerodynamic losses and a higher efficiency of the turbine arrangement. Particularly it may also be a goal to provide a turbine arrangement such that less sealing air is required during operation.

SUMMARY OF THE INVENTION

The present invention seeks to mitigate the mentioned drawbacks.

This objective is achieved by the independent claims. The dependent claims describe advantageous developments and modifications of embodiments of the invention.

In accordance with embodiments of the invention there is provided a turbine arrangement, i.e. particularly a turbine section of a gas turbine engine, including a rotor and a stator. The rotor rotates about a rotor axis and includes a plurality of rotor blade segments—segmented by annular segments—extending radially outward, wherein "outward" means a direction in respect of the rotor axis away from the rotor axis perpendicular to the rotor axis and wherein "radially" means a direction perpendicular to the rotor axis and starting from the rotor axis as a centre axis. Each rotor blade segment includes an aerofoil and a radially inner blade platform. "Radially inner platform" means a first boundary of a main fluid path is opposite to a second boundary, wherein the main fluid is guided between the first boundary and the second boundary and the first boundary limits the main fluid path in the direction of the rotor axis.

The stator surrounds the rotor so as to form an annular flow path for a pressurised working fluid—i.e. the main fluid—and the stator includes a plurality of guide vane segments—segmented by annular segments—disposed adjacent the plurality of rotor blades, wherein the plurality of guide vane segments extend radially inward. Each guide vane segment includes an aerofoil and a radially inner vane platform. The stator further includes a cylindrical stator wall co-axially aligned to the rotor axis and an annular stator wall arranged on a mid section of an outer surface of the cylindrical stator wall. "Mid section" means particularly that the cylindrical stator wall does not end with this annular stator wall but that the cylindrical stator wall extends in both directions of the annular stator wall.

The seal arrangement includes a trailing edge of the inner vane platform, a leading edge of the inner blade platform and a first annular cavity and a second annular cavity. "Leading" means an area of a component that is in contact with the working fluid first (an upstream end of the component), "trailing" means an area of the component that is in contact with the working fluid last (a downstream end of the component).

According to an embodiment of the invention the first annular cavity is defined at least by the trailing edge of the inner vane platform, a first part of the cylindrical stator wall and the annular stator wall. The second annular cavity is defined at least by the leading edge of the inner blade platform, a second part of the cylindrical stator wall and the annular stator wall. The first annular cavity is in fluid communication with the annular flow path via a first annular seal passage. The first annular cavity is separated from the second annular cavity via the annular stator wall, i.e. the annular stator wall forms a dividing wall between the first annular cavity and the second annular cavity. The first annular cavity is in fluid communication with the second annular cavity via a second annular seal passage between a rim of the annular stator wall and the leading edge of the inner blade platform, particularly a radial inward facing surface of the leading edge of the inner blade platform. Furthermore, the second annular cavity is in fluid communication with a hollow space for providing sealing fluid via a third annular seal passage.

These features form a fluidic rim seal to seal an annular gap between the radially inner vane platform and the radially inner blade platform.

The sealing effect is present as all introduced cavities, the annular flow path and the hollow space—the latter being typically a wheel space or a disc space between two rotor discs or between one rotor disc and an opposing stator surface—are in fluid flow communication, particularly limited by restrictions as defined by the first, second and third annular seal passages. The cavities allow recirculating flow within the cavities so that ingress of the working fluid into the first annular cavity and then into the second annular cavity is stepwise reduced. The effect is similarly present for an opposing fluid flow from the hollow space via the second annular cavity to the first annular cavity, so that the egress to the second annular cavity and further to the first annular cavity is stepwise reduced.

In the following several embodiments are discussed and also further explanations are provided related to the embodiments of the invention.

To define the arrangement further, the rotor axis is typically a central axis of the turbine engine and being a centre of a rotor shaft.

The guide vanes are arranged particularly to direct the pressurised fluid flowing onto the rotor blades when in use, so that the rotor blades will drive the rotor resulting in a rotation of the rotor.

At least between one row of guide vanes and one set rotor blades a seal arrangement as discussed is present, particularly between the guide vanes and the rotor blades of a first stage of the turbine arrangement, the first stage being located at an upstream end of the turbine arrangement. Embodiments of the invention also apply to subsequent stages of a turbine arrangement, wherein stages mean the order of pairs of a set of rotor blades and a set of guide vanes with a first stage closest to a burner arrangement.

Due to the presence of guide vanes—also called stator vanes—and rotor blades and due to the rotation of the rotor blades the pressure of the working fluid in the main fluid flow path in the region of first annular seal passage differs over time, i.e. the working fluid pulsates. According to an embodiment of the invention first annular cavity provides a damping effect to pressure-driven ingestion pulses. The second annular cavity provides even a further damping to pressure pulses.

The configuration may be defined in more detail in the following.

Particularly, the rim of the annular stator wall and the leading edge of the inner blade platform may overlap radially so that both may have opposing surfaces in a given radial plane. By this, the second annular seal passage is a restriction that allows fluid mainly in axial direction between the opposing surfaces.

Also the third annular seal passage may be defined of radially overlapping surfaces, i.e. the second part of the cylindrical stator wall may have an extension in axial direction such that an axially extending lip of a rotor wall may overlap in a given radial plane. The third annular seal passage may limit fluid flow mainly in axial direction between opposing surfaces of the lip and the cylindrical stator wall.

Furthermore, also the first annular seal passage may be limited by radially overlapping surfaces, i.e. the trailing edge of the inner vane platform extends in axial direction such that it overlaps a leading edge of the inner blade platform in a given radial plane.

Besides, the leading edge of the inner blade platform may be considered to be an edge which projects most in the direction of the upstream guide vane segment ("upstream" in respect of the working fluid flow), particularly beginning at the first annular seal passage.

According to an embodiment, the leading edge of the inner blade platform may comprise a cylindrical rotor wall at its leading end. This cylindrical rotor wall may form a cylinder such that it may have a substantially unmodified radial width over its axial length.

Alternatively, the cylindrical rotor wall may have a radially outwards facing concave surface with a width at its lip end greater than a width at another axial location of the cylindrical rotor wall. This would allow a region in which the working fluid would result in a circular flow in an area of the first annular seal passage so that less working fluid can pass the first annular seal passage.

To define the configuration further, the second annular seal passage may formed by a most leading end of the cylindrical rotor wall and the rim of the annular stator wall.

The leading edge of the inner blade platform may comprise downstream of the cylindrical rotor wall a continuous convex curvature surface facing the flow path. This allows merging the surface to the wanted width of the annular flow path of the working fluid. As a consequence it allows channelizing the working fluid back to the wanted fluid direction.

In a preferred embodiment the annular stator wall is arranged perpendicularly to the cylindrical stator wall. The annular stator wall may be completely straight or may comprise a bent. Particularly, for the latter option, the annular stator wall may comprise a first section and a second section, wherein the first section may be arranged perpendicularly to the cylindrical stator wall and the second section may be inclined or curved in respect to the first section, particularly in direction of the first annular cavity.

Besides, the second annular cavity may be defined furthermore by a substantially radially oriented ring surface of the rotor being substantially parallel to the annular stator wall. That means that the second annular cavity may be surrounded by the leading edge of the inner blade platform, a second part of the cylindrical stator wall, the annular stator wall, and the ring surface of the rotor. Thus, the third annular seal passage may be formed between the ring surface or a lip formed on the ring surface and the second part of the cylindrical stator wall.

In an embodiment, the second annular cavity may be defined furthermore by a substantially axially oriented flange of the rotor, wherein the third annular seal passage may be formed by an axial edge of the cylindrical stator wall and the flange. Alternatively, a lip or a step may be implemented instead of the flange. Again, there may be a radial overlap between the flange/lip/step surface and an opposing surface of the cylindrical stator wall in a specific radial plane.

In a first configuration, the flange of the rotor may have a radial distance to the rotor axis greater than a radial distance of the cylindrical stator wall to the rotor axis. Alternatively, in a second configuration the flange of the rotor may have a radial distance to the rotor axis less than a radial distance of the cylindrical stator wall to the rotor axis.

As a further alternative two flanges may be present, one as previously mentioned as first configuration and one as second configuration. More precisely, the second annular cavity may be defined furthermore by a substantially axially oriented first flange of the rotor, the rotor further including a substantially axially oriented second flange, wherein the first flange of the rotor may have a first radial distance D1 to the rotor axis greater than a second radial distance D2 of the cylindrical stator wall to the rotor axis. The second flange of the rotor may have a third radial distance D3 to the rotor axis less than the second radial distance D2 of the cylindrical stator wall to the rotor axis. Furthermore, the third annular seal passage may be formed by an axial edge of the cylindrical stator wall penetrating into a space between the first flange and the second flange. In a preferred embodiment, the first flange of the rotor, the axial edge of the cylindrical stator wall, and the second flange of the rotor may overlap radially in a specific radial plane.

Preferably, the third annular seal passage may comprise an axially oriented annular axial passage and a second radially oriented radial passage, the axial passage may be delimited by a shell surface of the cylindrical stator wall and a radially facing surface of the flange or the first flange. The radial passage may be delimited by a ring surface of the cylindrical stator wall and an axially facing surface of the rotor.

In a further embodiment it is advantageous to have two axially extending flanges. This is explained in a slightly different wording in an additional independent claim to define precisely the configuration of the seal arrangement. Nevertheless the following explanation does not deviate from the spirit of the invention that annular cavities and annular seal passages are arranged similarly as previously defined to generate the same effect (but possibly in a different magnitude). Thus, in an embodiment, the invention is also directed to a turbine arrangement including a rotor that rotates about a rotor axis and includes a plurality of rotor blade segments extending radially outward, each rotor blade segment includes an aerofoil and a radially inner blade platform; a stator surrounding the rotor so as to form an annular flow path for a pressurised working fluid, the stator includes a plurality of guide vane segments disposed adjacent the plurality of rotor blades, the plurality of guide vane segments extending radially inward, each guide vane segment including an aerofoil and a radially inner vane platform, the stator further including an annular stator partition wall coaxially aligned to the rotor axis, the annular stator partition wall including a radial flange, a first axial flange and a second axial flange; and a seal arrangement including a trailing edge of the inner vane platform, a leading edge of the inner blade platform and a first annular cavity and a second annular cavity. According to this variant of the invention embodiment the first annular cavity is defined at least by the trailing edge of the inner vane platform, a first part of the annular stator partition wall and the radial flange; the second annular cavity is defined at least by the leading edge of the inner blade platform, the radial flange and the first axial flange, the first annular cavity is in fluid communication with the annular flow path via a first annular seal passage; the first annular cavity is separated from the second annular cavity via the radial flange; the first annular cavity is in fluid communication with the second annular cavity via a second annular seal passage between a rim of the radial flange and the leading edge of the inner blade platform; the second annular cavity is in fluid communication with a hollow space for providing sealing fluid via a third annular seal passage; the third annular seal passage is formed by the first axial flange, the second axial flange and a radially oriented rotor flange penetrating into a space between the first axial flange and the second axial flange.

As previously said, this variant of the invention embodiment differs from a previous embodiment (in which two rotor flanges were present on the rotor and one stator flange penetrating into a space between the rotor flanges) that now two stator flanges are present on the stator and that a rotor flange penetrates into a space between the stator flanges.

Additionally the rotor face may have a depression opposite the first axial flange.

In a preferred embodiment to this variant of the invention embodiment, the radial flange is arranged perpendicularly to the annular stator partition wall. The radial flange may be completely straight or may comprise a bent. Particularly for the latter option, the radial flange may comprise a first section and a second section, wherein the first section may be arranged perpendicularly to the annular stator partition wall and the second section may be inclined or curved in respect to the first section, particularly in direction of the first annular cavity.

In all embodiments, a plurality of cooling fluid injectors—which may also be defined as inlets or nozzles—may be arranged underneath the trailing edge of the radially inner vane platform. Preferably, cooling fluid is provided to an area with minor circulation within the first annular cavity. Furthermore, the cooling fluid inlet may allow bringing the ingested working fluid to an overall rotational movement within the first annular cavity.

Such an overall rotational movement within the first annular cavity without additional turbulences may be supported by a smooth curvature between surfaces with different orientation. It may be advantageous to have all contact regions of surfaces with different orientation with smooth curvature or smooth surface transition in the regions of the first annular cavity, the second annular cavity, and/or the third annular cavity.

The seal arrangement as previously discussed may be considered a separate element or could be simply be seen as a logical part defined by the rotor and the stator, i.e. defined by a part of the guide vane segment and a part of the rotor blade segment—with or without its adjacent section of the rotor disc to which the rotor blades get connected.

"Trailing" means throughout this document the downstream side (of the main fluid stream, ignoring turbulences) once the arrangement is in use, "leading" means the upstream side.

The above mentioned turbine arrangement may allow reducing the amount of seal fluid that enters via the cavities and the annular passages into the main annular flow path. Mainstream fluid flow will be disrupted less so that aerodynamic losses are reduced in the area of the aerofoil of the rotor blade. Also hot fluid may not be able to fully pass the seal arrangement.

The mainstream fluid may particularly be a combustion fluid, particularly a gas that was accelerated via a combustion chamber where mixing and burning compressed air with liquid or gaseous fuel takes place.

The seal fluid or seal leakage fluid is preferably a cooling fluid, preferably air taken from a compressor. The seal fluid may be compressed, resulting in a pressure substantially in the range of the pressure of the pressurised fluid in the annular flow or resulting in a pressure even greater than the pressure of the pressurised fluid in the annular flow path. In other embodiments the pressure of the seal fluid may be less than the pressure of the pressurised fluid in the annular flow path.

In a preferred embodiment, the first annular seal passage may be slanted. Particularly, it may be directed, starting from the first annular cavity, radially outwards and downstream—downstream in respect of egressing seal fluid or opposite of a potentially entering pressurised mainstream fluid—with an angle of substantially 25 to 45 degree in respect of the rotor axis.

The direction of the first annular seal passage may be defined due to an overhanging portion defined by the trailing edge of the inner vane platform. The egressing seal fluid or the ingressing hot mainstream fluid may be directed to the back side of the overhanging portion rearwardly of the trailing edge of the aerofoil of the vane and due to the orientation of the back side, the seal fluid may be led with the given angle via the first annular seal passage into the annular flow path and the mainstream fluid may be led with the given angle via the first annular seal passage into the first annular cavity.

In an embodiment, the invention also benefits from the effect that a rotating wheel, e.g. the rotor disc on which the rotor blades are mounted, has a surface that will lead to a pumping effect to pump a provided sealing fluid from a central region to a radial outward region. That means that sealing fluid is pumped into the third annular seal passage and/or to the second radially oriented radial passage. This pumping effect enhances the sealing effectiveness in respect of a potential counter flow of hot gas ingesting into the cavities via the annular seal passages.

Due to the pumping effect of the rotating wheel for the sealing fluid, also the previously introduced rotating surfaces may be cooled.

Embodiments of the invention may also be directed to a gas turbine engine including such a turbine arrangement as previously discussed, particularly a gas turbine engine including a turbine arrangement, wherein the turbine arrangement is arranged according to one of the previously disclosed embodiments or to one of the embodiments disclosed in the following.

The previously discussed seal arrangement is a rim seal, more particularly a fluidic rim seal. It particularly is not a inter disc seal. It particularly also is not a labyrinth seal. A labyrinth seal may be additionally be present at a further radial inwards location away from the main fluid path. The seal arrangement according to an embodiment of the invention particularly has passages as restrictions but does not have surfaces of stator and rotor that are in direct physical contact. The sealing effect is a result of the form of the cavities and the passages but also a result of the fluid flow field. The passages according to an embodiment of the invention still allow a fluid flow through the passage but due to orientation, size and configuration, the through flow of fluid through passages is limited.

It has to be noted that embodiments of the invention have been described with reference to different subject matters. In particular, some embodiments have been described with reference to apparatus type claims whereas other embodiments have been described with reference to the operation of an engine. However, a person skilled in the art will gather from the above and the following description that, unless other notified, in addition to any combination of features belonging to one type of subject matter also any combination between features relating to different subject matters, in particular between features of the apparatus type embodiments and features of the method type embodiments is considered as to be disclosed with this application.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematically. It is noted that for similar or identical elements in different figures, the same reference signs will be used.

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation.

An embodiment of the invention may also be applied generally to a flow machine.

DETAILED DESCRIPTION OF THE INVENTION

In the following all embodiments will be explained for a gas turbine engine.

Not shown in the figures, a gas turbine engine includes a compressor section, a combustor section and a turbine section which are arranged adjacent to each other. In operation of the gas turbine engine ambient air or a specific fluid is compressed by the compressor section, mainly provided as an input to the combustor section with one or more combustors and burners. In the combustor section the compressed air will be mixed with liquid and/or gaseous fuel and this mixed fluid is burnt, resulting in a hot fluid which is accelerated by the guide vanes given a high velocity and a reduced static pressure. The hot fluid is then guided from the combustor to the turbine section, in which the hot fluid will drive one or more rows of rotor blades resulting in a rotational movement of a shaft. Finally the fluid will be led to an exhaust.

The direction of the fluid flow will be called "downstream" from the inlet via the compressor section, via the combustor section to the turbine section and finally to the exhaust. The opposite direction will be called "upstream". The term "leading" corresponds to an upstream location, "trailing" corresponds to a downstream location. The turbine section may be substantially rotational symmetric about an axis of rotation. A positive axial direction may be defined as the downstream direction. In the following figures, the hot fluid will be guided substantially from left to right in parallel to the positive axial direction.

Figure 1:
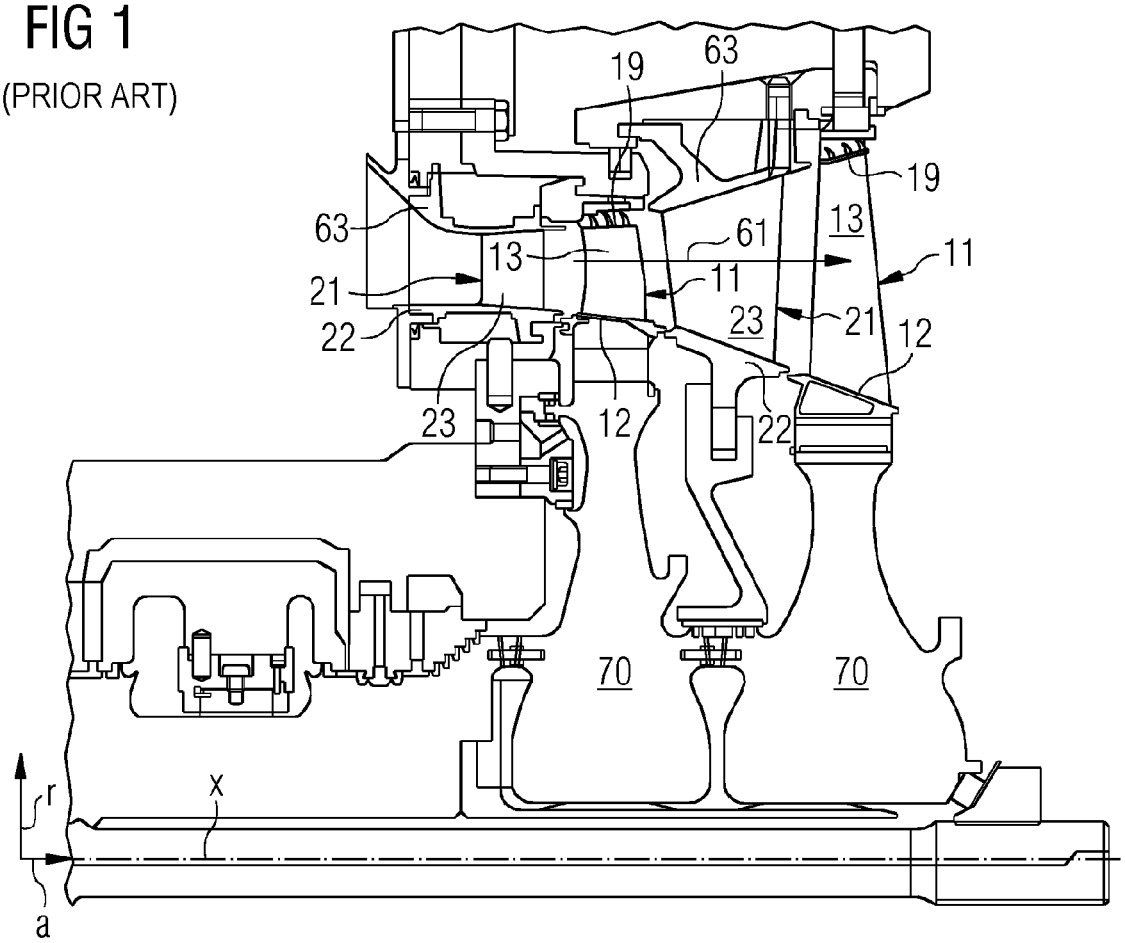
FIG 1 (PRIOR ART)
FIG. 1: shows schematically a section through a high pressure portion of the gas turbine engine according to the prior art.

Referring now to FIG. 1, a set of guide vanes 21 and rotor blades 11 are shown. The first set of guide vanes 21 is located immediately downstream of the combustion chamber arrangement (not shown). Each guide vane 21 in the set of guide vanes 21 includes an aerofoil 23 extending in an approximately radial direction—indicated by arrow r—with respect to a centre axis x of the turbine section and an outer platform 63 for the mounting of the guide vane 21 in a housing or a casing, the housing and the outer platform 63 being a part of a stator, i.e. being non-rotational. Each guide vane 21 also has an inner vane platform 22 for forming a stationary, annular supporting structure at a radially inner position of the aerofoils 23 of the guide vane 21.

The pair of platforms 22 and 63 and the aerofoil 23 typically are built as a one-piece guide vane segment and a plurality of guide vane segments are arranged circumferentially around the centre axis x to build one guide vane stage. The platforms 22 and 63 are arranged to form an annular flow path or flow passage for hot combustion gases—a pressurised fluid 61—, the flow direction indicated by an arrow with reference sign 61. Consequently, the platforms 22 and 63 may need to be cooled. Cooling means may be provided for both the inner platforms 22 and outer platforms 63. Cooling fluid may be for instance air or carbon dioxide arriving directly from the compressor part of the gas turbine engine without passing through the combustion chamber arrangement.

Immediately downstream of the shown guide vane stage, there is the first rotor stage including a number of rotor blades 11. The rotor blades 11 comprise an inner platform 12 and a shroud 19 forming a continuation of the annular flow path so that the pressurised fluid will be guided downstream as indicated by arrow a (or arrow with reference symbol 61). Between the inner platform 12 and the shroud 19 a plurality of rotor blades 11 will be present. A single inner platform section, a single rotor blade aerofoil and a single shroud may form one rotor blade segment. A plurality of rotor blade segments are connected to a rotor disc 70 which allows a rotational movement and which will drive a rotor shaft.

Figure 2:
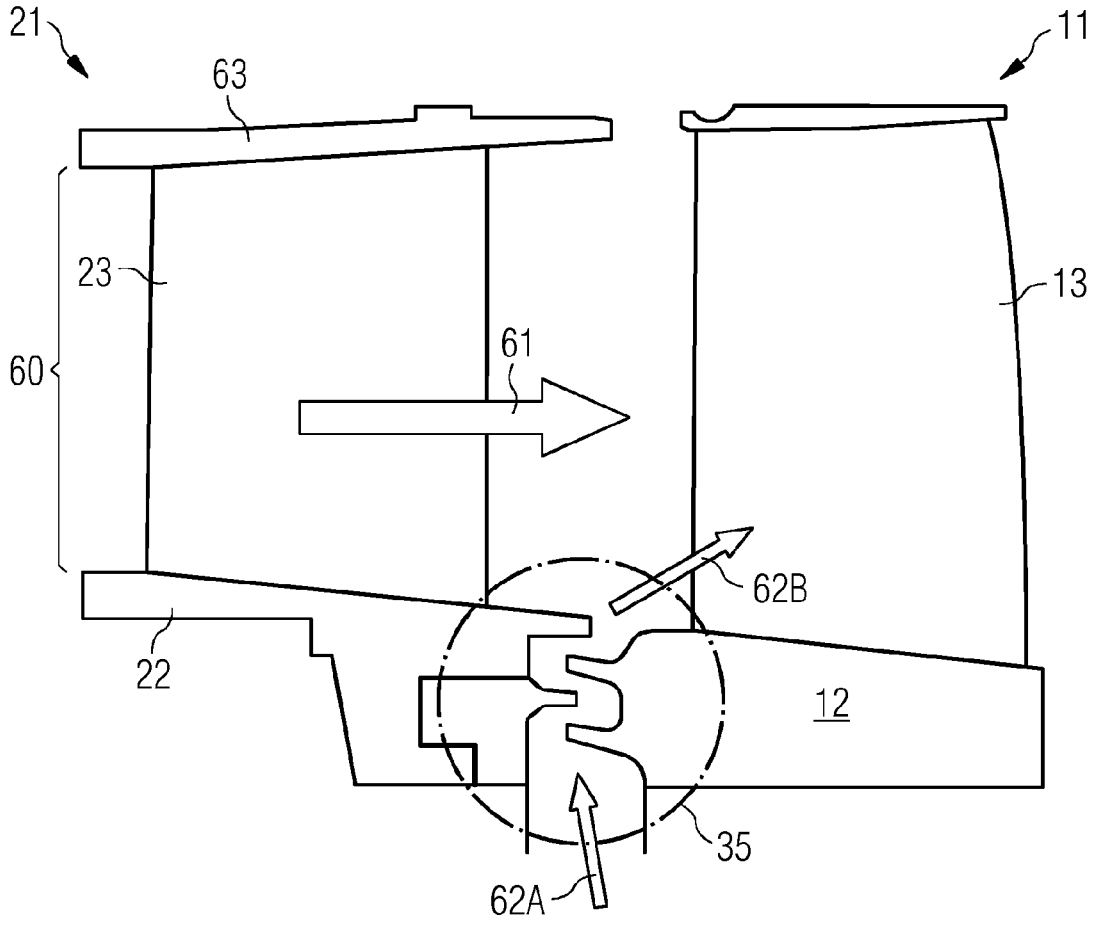
FIG 2 (PRIOR ART)
FIG. 2: shows schematically a section of a prior art turbine arrangement.

Between the rotating parts—the rotor—and the stationary parts—the stator—sealing arrangements may be present so that the pressurised fluid 61 will stay in the annular flow path 60 (as indicated in FIG. 2) and will not mix directly with a secondary fluid, e.g. provided for cooling. Thus, between the inner platforms 22 of the guide vanes 21 and the inner platforms 12 of the rotor blades 11 a seal arrangement is present, which will be looked at in the following figures. This seal arrangement is called a rim seal. Such a rim seal will be present between all interfaces between rotor blades and guide vanes, i.e. upstream and downstream of a rotor blade when there is an upstream and downstream guide vane.

In the following, when discussing FIGS. 2 to 4, a closer look is taken to a single guide vane of a plurality of guide vanes and its adjacent downstream rotor blade, representing one of a plurality of rotor blades.

Referring now to FIG. 2, a prior art turbine arrangement is shown including a stator for which only a single guide vane 21 is shown. The guide vane 21 includes an outer platform 63, an inner platform 22, and an aerofoil 23. Furthermore the turbine arrangement also includes a rotor for which only a single rotor blade 11 is shown. The rotor blade 11 includes an inner blade platform 12 and an aerofoil 13. The rotor blade 11 may additionally comprise an outer platform or a shroud at a radial distant end of the rotor blade 11, the distant end being at an opposite end compared to the inner blade platform 12.

Between the mentioned outer and inner platforms an annular flow path 60 is formed through which pressurised fluid 61—indicated by an arrow—, preferably a hot gas provided by a combustor, is guided to drive the plurality of rotor blades 11.

Between the guide vane 21 and the rotor blade 11 a seal arrangement 35 is shown, formed according to the prior art. The seal arrangement provides a sealing mechanism between the inner vane platform 22 and the inner blade platform 12. Fluid from the main annular flow path 60 may enter the seal arrangement 35 during operation. In other modes of operation a sealing fluid 62B may enter the main annular flow path 60. This may be caused by a pressure difference between the provided sealing fluid 62A and the pressurised fluid 61 in the main annular flow path 60. The pressure difference may be local around the circumference of the seal arrangement 35 and caused by the pressure gradients surrounding the blades and vanes during operation of the gas turbine engine.

Figure 3:
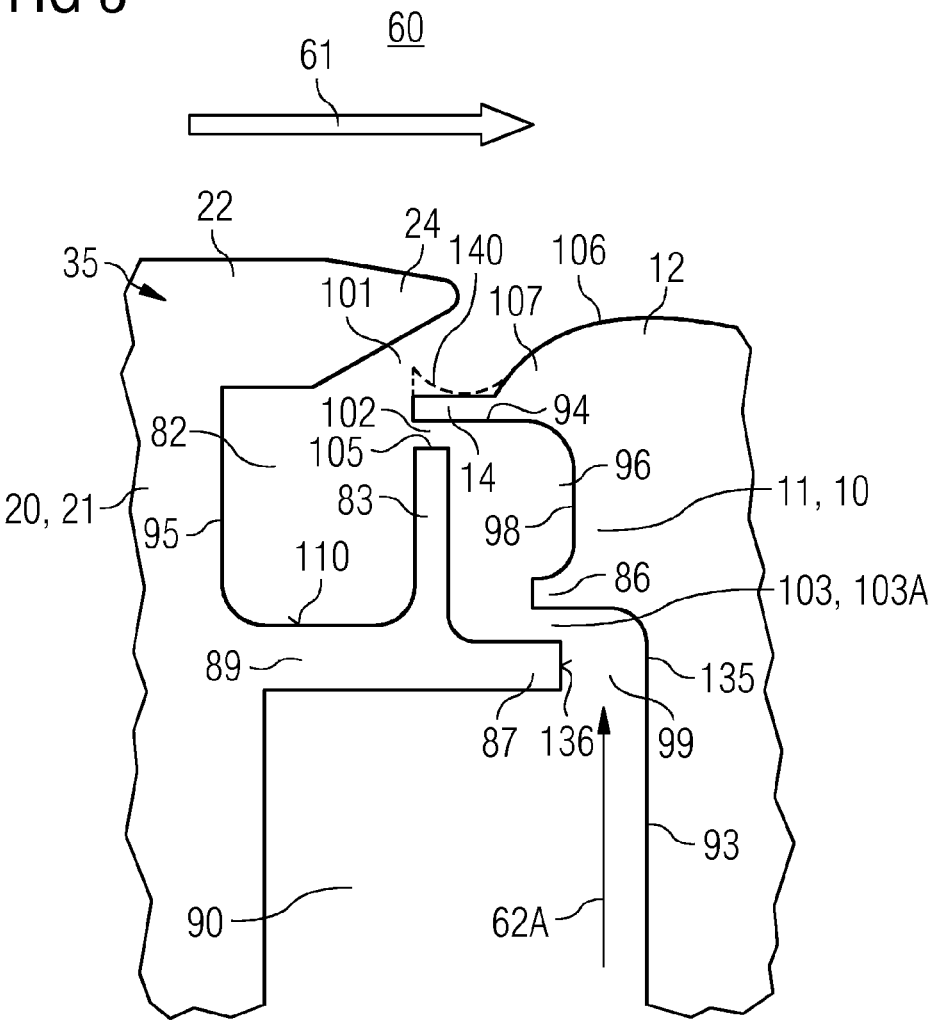
FIG. 3: shows schematically a section of a turbine arrangement according to an embodiment of the invention.

Referring now to FIG. 3, a turbine arrangement according to an embodiment of the invention is shown. Similar reference signs as before are used, to show equivalent elements. In FIG. 3, only component parts are shown that are located in the area of the rim seal arrangement.

The turbine arrangement depicts a part of a stator 20 on the left hand side—i.e. upstream—and a part of a rotor 10 on the right hand side—i.e. downstream. The rotor 10 is set up to rotate about a rotor axis and includes a plurality of rotor blade segments 11 extending radially outward, each rotor blade segment 11 includes an aerofoil 13 (not shown in FIG. 3) and a radially inner blade platform 12.

The stator surrounds—i.e. being a radial outwards boundary of a flow path—the rotor in each plane perpendicular to the rotor axis. The rotor is a radial inwards boundary of the flow path. Thus, the stator surrounds the rotor so as to form an annular flow path for a pressurised working fluid (the working fluid flow is indicated via arrow 61). Parts of the stator (i.e. the guide vane aerofoils) and parts of the rotor (i.e. the rotor blade aerofoils) project into the flow path.

The stator 20 includes a plurality of guide vane segments 21 disposed adjacent the plurality of rotor blades segments 11, the plurality of guide vane segments 21 extending radially inward, each guide vane segment 21 including an aerofoil 23 (not shown in FIG. 3) and a radially inner vane platform 22.

The stator 20 further includes a cylindrical stator wall (see reference signs 89 and 87) coaxially aligned to the rotor axis and an annular stator wall 83 arranged on a mid section of an outer surface 110 of the cylindrical stator wall.

The shown turbine arrangement furthermore includes a seal arrangement 35. The seal arrangement 35 including—or is delimited by—a trailing edge 24 of the inner vane platform 22, a leading edge 107 of the inner blade platform 12 and a first annular cavity 82 and a second annular cavity 96.

The first annular cavity 82 and the second annular cavity 96 are arranged, sized and connected such that a sealing effect is provided during operation.

More specifically, the first annular cavity 82 is defined at least by the trailing edge 24 of the inner vane platform 22, an axial stator surface 95, a first part 89 of the cylindrical stator wall and the annular stator wall 83. Via these surfaces an annular cavity—i.e. the first annular cavity 82—is provided with additional fluid passages which allow compensation of pressure differences between the cavity and neighbouring fluid volumes.

The second annular cavity 96 is defined at least by the leading edge 107 of the inner blade platform 12, a second part 87 of the cylindrical stator wall and the annular stator wall 83. According to FIG. 3, the second annular cavity 96 is defined furthermore by a substantially radially oriented ring surface 98 of the rotor 10 being substantially parallel to the annular stator wall 83. As before, via these surfaces an annular cavity—i.e. the second annular cavity 96—is provided with additional fluid passages which allow compensation of pressure differences between the cavity and neighbouring fluid volumes.

According to the configuration of FIG. 3, the first annular cavity 82 is separated from the second annular cavity 96 via the annular stator wall 83 which acts like a divider but allowing fluid communication via an additional passage between the two mentioned annular cavities (82, 96).

The first annular cavity 82 is arranged such that it is in fluid communication with the annular flow path 60 via a first annular seal passage 101.

The first annular cavity 82 is also in fluid communication with the second annular cavity 96 via a second annular seal passage 102 between a rim 105 of the annular stator wall 83 and the leading edge 107 of the inner blade platform 12.

Besides, the second annular cavity 96 is also in fluid communication with a hollow space 90—particularly a wheel space next to a rotor wheel—for providing sealing fluid via a third annular seal passage 103.

That means cooling fluid provided via the hollow space 90 has a fluidic connection to the hot gas in the main path via third annular seal passage 103, second annular cavity 96, second annular seal passage 102, first annular cavity 82, first annular seal passage 101 (in that given order).

In FIG. 3 a more specific configuration is shown which is also explained in the following.

In FIG. 3 the leading edge 107 of the inner blade platform 12 includes a cylindrical rotor wall 14 at its leading end. The cylindrical rotor wall 14 has a substantially un-modified radial width over its axial length. The leading edge 107 of the inner blade platform 12 also includes downstream of the cylindrical rotor wall 14 a continuous convex curvature surface 106 facing the flow path 60 and/or in parts being a wall of the first annular seal passage 101. The connection area between the cylindrical rotor wall 14 and the convex curvature surface 106 may be a bend.

Alternatively, as shown as dashed line, the cylindrical rotor wall 14 has a radially outwards facing concave surface 140 with a width at its lip end greater than a width at another axial location of the cylindrical rotor wall 14. The radially outwards facing concave surface 140 may smoothly merge into the convex curvature surface 106. This may generate a rotational flow in the region of the first annular seal passage 101 leading to a better sealing effect.

Furthermore, the second annular seal passage 102 is formed by a most leading end of the cylindrical rotor wall 14—particularly its radially inwards facing surface 94—and the (radially outwards facing) rim 105 of the annular stator wall 83.

The annular stator wall 83 shown in FIG. 3 is arranged perpendicularly to the cylindrical stator wall (89, 87). The annular stator wall 83 is forming a cylinder with a (small) axial height and a radial wall width of the cylinder, the radial wall width being a plurality of the axial height.

Later it will be shown in FIGS. 4C and 4F, that the annular stator wall 83 will not always be a perfect cylinder but may includes a first section 121 and a second section 122, wherein the first section 121 is arranged perpendicularly to the cylindrical stator wall (89, 87) and the second section 122 is inclined or curved in respect to the first section 121, particularly in direction of the first annular cavity 82.

In the depicted configuration of FIG. 3, the second annular cavity 96 is defined furthermore by a substantially axially oriented flange 86 of the rotor 10—particularly of the rotor disc side face or a side face of the rotor blade segment 11—, wherein the third annular seal passage 103 is formed by an axial edge of the cylindrical stator wall (89, 87)—i.e. the second part of the cylindrical stator wall 87—and the flange 86. Whereas the second part of the cylindrical stator wall 87 is directed in a positive axial direction, the axially oriented flange 86 of the rotor 10 is directed in opposite direction. The radial position of the axially oriented flange 86 may be further outwards than the radial position of the cylindrical stator wall 87 as shown in FIG. 3, 4A, 4C, or may be further inwards than the radial position of the cylindrical stator wall 87 (see FIG. 4D).

Due to the presence of the cylindrical rotor wall 14, the axially oriented flange 86 of the rotor 10, both being directed in the negative axial direction and due to the ring surface 98 of the rotor 10, an undercut of the axial rotor face is created being an integral part of the second annular cavity 96.

In the configuration of FIG. 3, the third annular seal passage 103 is formed as a bent passage. The third annular seal passage 103 includes an axially oriented annular axial passage 103A and a second radially oriented radial passage 99 which merge into another. The axial passage 103A delimited by a radially outwards facing shell surface of the second part 87 of the cylindrical stator wall and a radially inwards facing surface of the flange 86. The radial passage 99 is delimited by a ring surface 136 of the second part 87 facing in the positive axial direction and an axially facing surface 135 (directed in the negative axial direction) of the rotor 10.

The radial passage 99 may provide the transition to the wheel space or hollow space 90.

Even though basically no fluid flow inside the seal arrangement is shown, only the main pressurised fluid flow 61 is shown and a sealing fluid flow 62A is indicated led by the rotating rotor disc in a radial outwards direction along an axially facing rotor disc surface 93 through the hollow space 90 into the radial passage 99.

Thus, this depicted configuration of FIG. 3 includes specific features like that a radial arm of the cylindrical rotor wall 14 has a horizontal or inclined orientation and forms with the inner blade platform 12 the rotor platform.

The trailing edge 24 of the inner vane platform 22 forms with cylindrical rotor wall 14 the first radial overlap seal. The first annular cavity 82 is the main buffer cavity to reduce the ingestion driving tangential pressure variation by the highly swirling motion of the fluid within this cavity. This first annular cavity 82 is formed by the axial stator surface 95 or a present cover plate (not shown) and by the other stationary parts of the annular stator wall 83 and the first part 89 of the cylindrical stator wall.

The second annular cavity 96—an inner cavity—formed by of the annular stator wall 83 as a vertical arm, the second part 87 of the cylindrical stator wall as a horizontal arm and further rotor surfaces damps out the residual pressure variation which enters through the clearance of second annular seal passage 102.

The lower part of the cylindrical rotor wall 14 as a radial arm is horizontally oriented to ensure a constant vertical clearance between the cylindrical rotor wall 14 (i.e. its radially inwards facing surface 94) and the annular stator wall 83 (particularly its tip, i.e. rim 105) throughout the axial movement of both the stator and the rotor.

The axially oriented flange 86 and second part 87 of the cylindrical stator wall form the second radial overlap seal which separates the inner buffer cavity—i.e. second annular cavity 96—from the main wheel space, i.e. hollow space 90. This radial-clearance seal distinguishes from conventional rim-seal designs by the fact that the radial lip in form of the axially oriented flange 86 is located radially outwards or above of the second part 87 of the cylindrical stator wall.

As previously said, the sealing fluid flow 62A supplied to the lower part of the hollow space 90 as a main cavity attaches to the rotating rotor disc surface 93 and it is pumped upwards—i.e. radially outwards—by the disc pumping effect in rotor-stator cavities. The third annular seal passage 103 as a radial-clearance seal arrangement allows the sealing flow pumped directly into opening of the second radially oriented radial passage 99 and the rim-seal.

The pressurised radial-clearance seal defined by the third annular seal passage 103 provides a continuous protective sealing curtain spread between the second part 87 of the cylindrical stator wall and by the third annular seal passage 103 to stop ingested hot fluid from further migrating into the hollow space 90, i.e. the main cavity, even at low sealing flow rates. The sealing flow in the radial overlap seal defined by the third annular seal passage 103 attaches with the second annular cavity 96 to the rotating ring surface of the rotor 98 again and is pumped upwards through the disc pumping effect to provide a protective cooling layer to the rotor blade 11. Then it provides sealing flow for seal clearance of the second annular seal passage 102.

To improve the sealing effect several transition regions between substantially perpendicular surfaces are implemented as smoothly curved surfaces, e.g. being a quarter of a circle when viewed in a sectional view as FIG. 3. This allows guiding fluid without major disruption. This smooth transition between perpendicular surfaces applies to the transition between the axial stator surface 95 and the outer surface 110 of the first part 89 of the cylindrical stator wall, the transition between the outer surface 110 of the first part 89 of the cylindrical stator wall and the annular stator wall 83, the transition between the annular stator wall 83 and the second part 87 of the cylindrical stator wall, the transition between the inwards facing surface 94 of cylindrical rotor wall 14 and the ring surface 98 of the rotor, the transition between the ring surface 98 and the axially oriented flange 86 of the rotor, and the transition between the axially oriented flange 86 and the axially facing surface 135 of the rotor.

The configuration of FIG. 3 shows particularly the advantage that the second annular cavity 96 adjacent to the first annular cavity 82 as a main buffer cavity damps out the residual tangential pressure gradient. Therefore less static pressure is required in main wheel-space (i.e. the hollow space 90) to purge the cavity of the hollow space 90 to avoid hot gas ingestion entering the hollow space 90—which means a reduction in sealing flow.

By using the disc pumping effect—i.e. radial outflow of the sealing fluid flow 62A near the rotor disc by the centrifugal forces of the fluid in conjunction with a high tangential velocity component—the space between the axially oriented flange 86 of the rotor and the second part 87 of the cylindrical stator wall is pressurised. This creates a protective curtain of sealing flow to shield the hot fluid from further migrating into the main cavity, i.e. hollow space 90. The use of the disc pumping effect for sealing purposes reduces the level of ingested fluid in the hollow space 90. The rotating motion of the rotor ensures that the sealing flow attaches to the rotor in the second annular cavity 96 to build a protective layer to shield the rotor from the incoming hot gas. This further reduces the heat flux into the rotor.

In FIG. 4 now different configurations of the invention embodiments are shown.

Figure 4A:
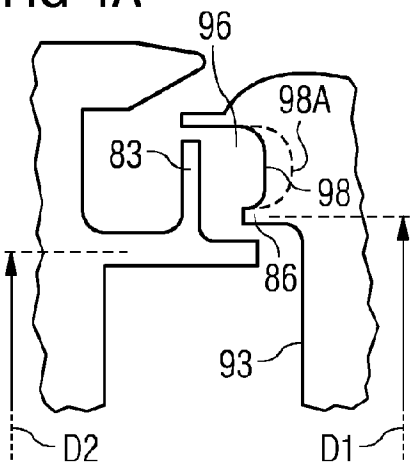
FIG. 4: shows schematically variants of different sections of a turbine arrangement according to an embodiment of the invention.

In FIG. 4A a similar configuration is shown as discussed in relation to FIG. 3, in which the axially oriented flange 86 of the rotor 10 has a first radial distance D1 to the rotor axis greater than a second radial distance D2 of the cylindrical stator wall (89, 87) to the rotor axis. In this case the axially oriented flange 86 projects into the second annular cavity 96.

According to FIG. 4A the ring surface 98 of the rotor may have a lesser axial distance to the annular stator wall 83 than the rotor disc surface 93 (the rotor disc surface 93 being closer to the rotor axis than the ring surface 98).

Indicated by dashed lines, an alternative ring surface 98A of the rotor may be substantially be in the same plane as the rotor disc surface 93. More general, the axially oriented flange 86 of the rotor may be axially elongated.

Figure 4B:
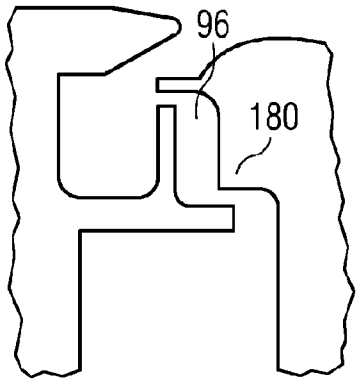

According to FIG. 4B, the axially oriented flange 86 may not be present. In this case the second annular cavity 96 merely is surrounded by the surfaces of the inwards facing surface 94 of cylindrical rotor wall 14, the annular stator wall 83, the second part 87 of the cylindrical stator wall and the ring surface 98 of the rotor. By this configuration the axial rotor wall forms a step 180. The step being a transition surface between the ring surface 98 and the rotor disc surface 93. The ring surface 98 of the rotor may have a lesser axial distance to the annular stator wall 83 than the rotor disc surface 93 (the rotor disc surface 93 being closer to the rotor axis than the ring surface 98).

Figure 4C:
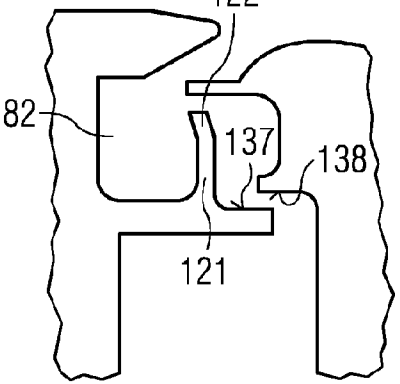

FIG. 4C shows a configuration similar to FIG. 4A with an annular stator wall 83 that includes a straight portion of the annular stator wall 83 as a first section 121 and a bent portion of the annular stator wall 83 as a second section 122. The first section 121 is arranged perpendicularly to the cylindrical stator wall (89, 87) and the second section 122 is inclined in respect to the first section 121, particularly in the example in direction of the first annular cavity 82.

In the FIG. 4C again the third annular seal passage 103 is comprised of an axially oriented annular axial passage 103A and a second radially oriented radial passage 99. The axial passage 103A is delimited by a shell surface 137 of the cylindrical stator wall (89, 87) and a radially facing surface 138 of the flange 86.

Figure 4D:
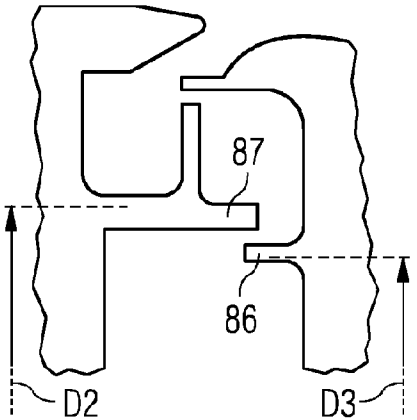

FIG. 4D shows a variant of FIG. 4A, in which the axially oriented flange 86 of the rotor is closer to the rotor axis than the cylindrical stator wall (89, 87). That means that the axially oriented flange 86 of the rotor has a third radial distance D3 to the rotor axis less than the radial distance D2 of the cylindrical stator wall (89, 87) to the rotor axis.

Figure 4E:
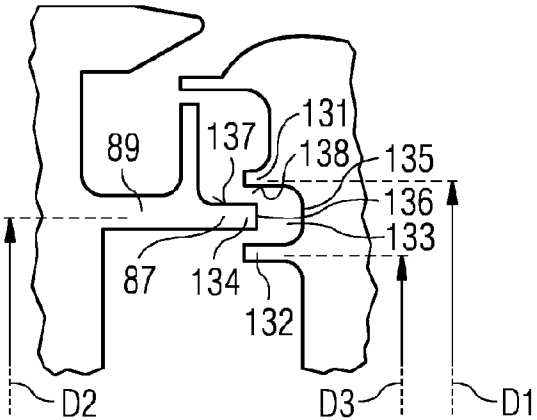

In FIG. 4E a configuration is depicted in which the third annular seal passage 103 includes two axial passages and one radial passage in between. In particular, the second annular cavity 96 is defined furthermore by a substantially axially oriented first flange 131 of the rotor, the rotor further including a substantially axially oriented second flange 132. The first flange 131 is configured similarly to the axially oriented flange 86 as shown in FIG. 4A. The first flange 131 has a radial distance D1 to the rotor axis greater than a radial distance D2 of the cylindrical stator wall (89, 87) to the rotor axis, and the second flange 132 of the rotor has a radial distance D3 to the rotor axis less than the radial distance D2 of the cylindrical stator wall (89, 87) to the rotor axis. The third annular seal passage 103 is then formed by an axial edge 134 of the cylindrical stator wall (89, 87) penetrating into a space 133 between the first flange 131 and the second flange 132.

Figure 4F:
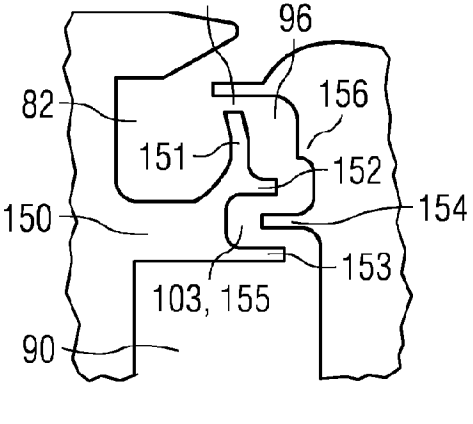

In a further configuration as shown in FIG. 4F, the third annular seal passage 103 again is modified such that only a single rotor flange is extending from the rotor and penetrating between two stator flanges present at the axial end of the second part 87 of the cylindrical stator wall.

In more detail the configuration of FIG. 4F is defined as showing a turbine arrangement including again a rotor with rotor blade segments and a stator with guide vane segments as before, depicted in a cross sectional view. The stator now further includes an annular stator partition wall 150 coaxially aligned to the rotor axis, the annular stator partition wall 150 including, in turn, a radial flange 151, a first axial flange 152 and a second axial flange 153. The first annular cavity 82 now is defined at least by the trailing edge 24 of the inner vane platform 22, a first part of the annular stator partition wall 150 and the radial flange 151. The second annular cavity 96 is now defined at least by the leading edge 107 of the inner blade platform 12, the radial flange 151 and the first axial flange 152. The first annular cavity 82 is separated from the second annular cavity 96 via the radial flange 151, similar to the previous embodiments. That means that the first annular cavity 82 is in fluid communication with the second annular cavity 96 via a second annular seal passage 102 between a rim of the radial flange 151 and the leading edge 107 of the inner blade platform 12. Now turning to the third annular seal passage 103, as before, the second annular cavity 96 is in fluid communication with the hollow space 90 for providing sealing fluid via the third annular seal passage 103. According to the embodiment of FIG. 4F, the third annular seal passage 103 is now formed by the first axial flange 152, the second axial flange 153 and a radially oriented rotor flange 154 penetrating into a space 155 between the first axial flange 152 and the second axial flange 153.

Furthermore, the ring surface 98 of the rotor has a step 156 such that a first ring surface section is a boundary of the second annular cavity 96, whereas a second ring surface is opposite to the first axial flange 152. The second ring surface has a larger distance to the radial flange 151 than the first ring surface.

This configuration results in a serpentine like third annular seal passage 103.

Similar to FIG. 4C, the radial flange 151 of FIG. 4F may comprise a straight portion of the radial flange 151 and a bent portion. Alternatively the radial flange 151 may be continuously curved with a dominant extension in radial direction and a minor deviation from this radial direction in the negative axial direction when progressing to the tip of the radial flange 151.

Figure 5:
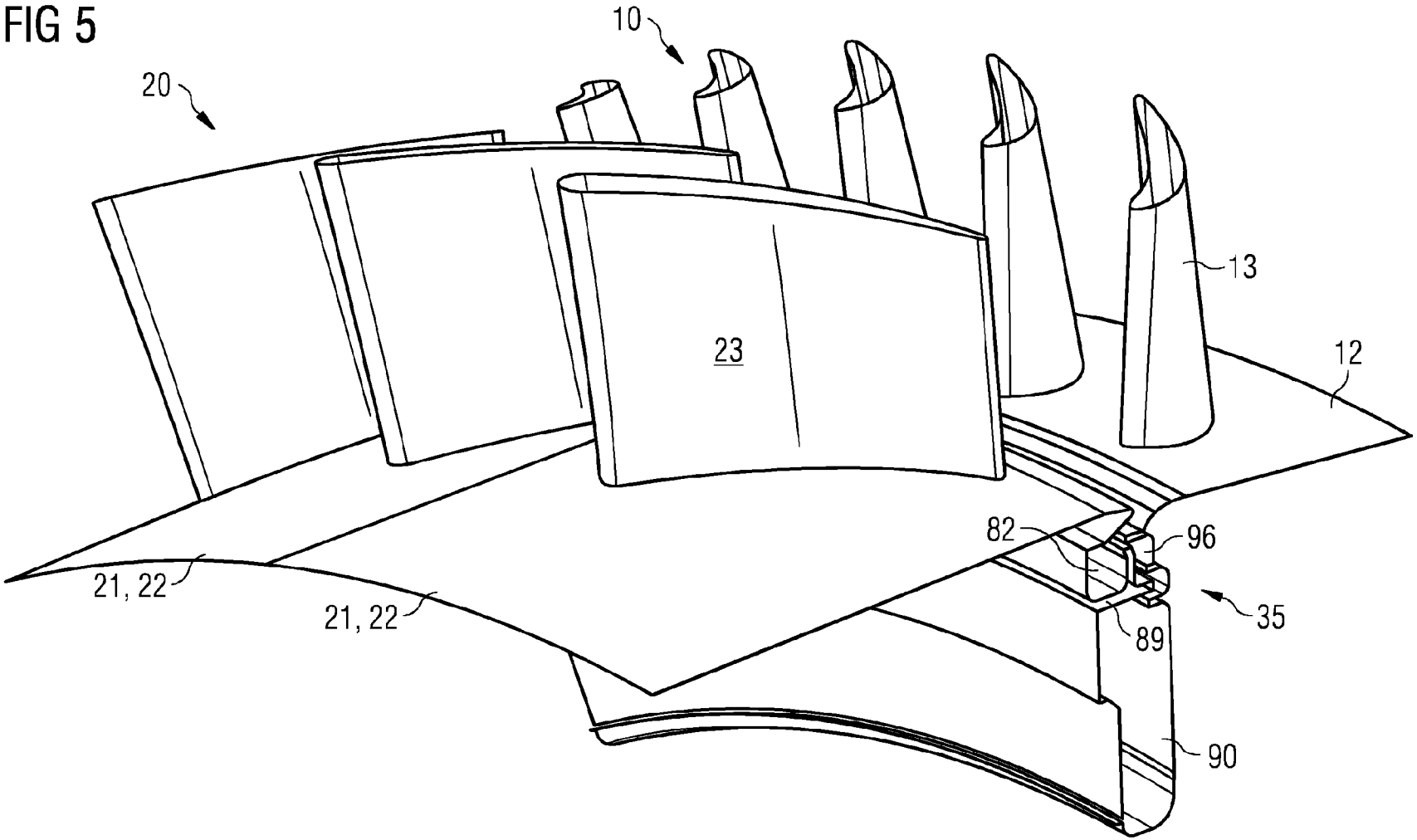
FIG. 5: shows schematically a sectional three dimensional view of a turbine arrangement according to an embodiment of the invention.

The configuration of FIG. 4E is now shown in a three dimensional view in FIG. 5, in which only the surfaces of the rotor 10 and the stator 20 are shown, such that as one could see through the surfaces. Three aerofoils 23 stator vanes are shown and five aerofoils 13 of rotor blades. Two inner platforms 22 of guide vane segments 21 are visible. Also the inner platforms 12 of the rotor blade segments can be seen.

The seal arrangement 35 can be seen from an angled view. The annular shape of the different cavities and the rotational symmetry of flanges and surfaces becomes apparent. Explicitly referenced are the first annular cavity 82, the second annular cavity 96, and first part 89 of the cylindrical stator wall. Besides the hollow space 90 can be seen which ends a radial inner end via a labyrinth seal (which is not clearly shown).

What becomes clear when looking at FIG. 5 is that the seal arrangement 35 forms a rim seal. It particularly does not form a labyrinth seal or another type of seal that would require physical contact of stator and rotor surfaces during operation.

Figure 6:
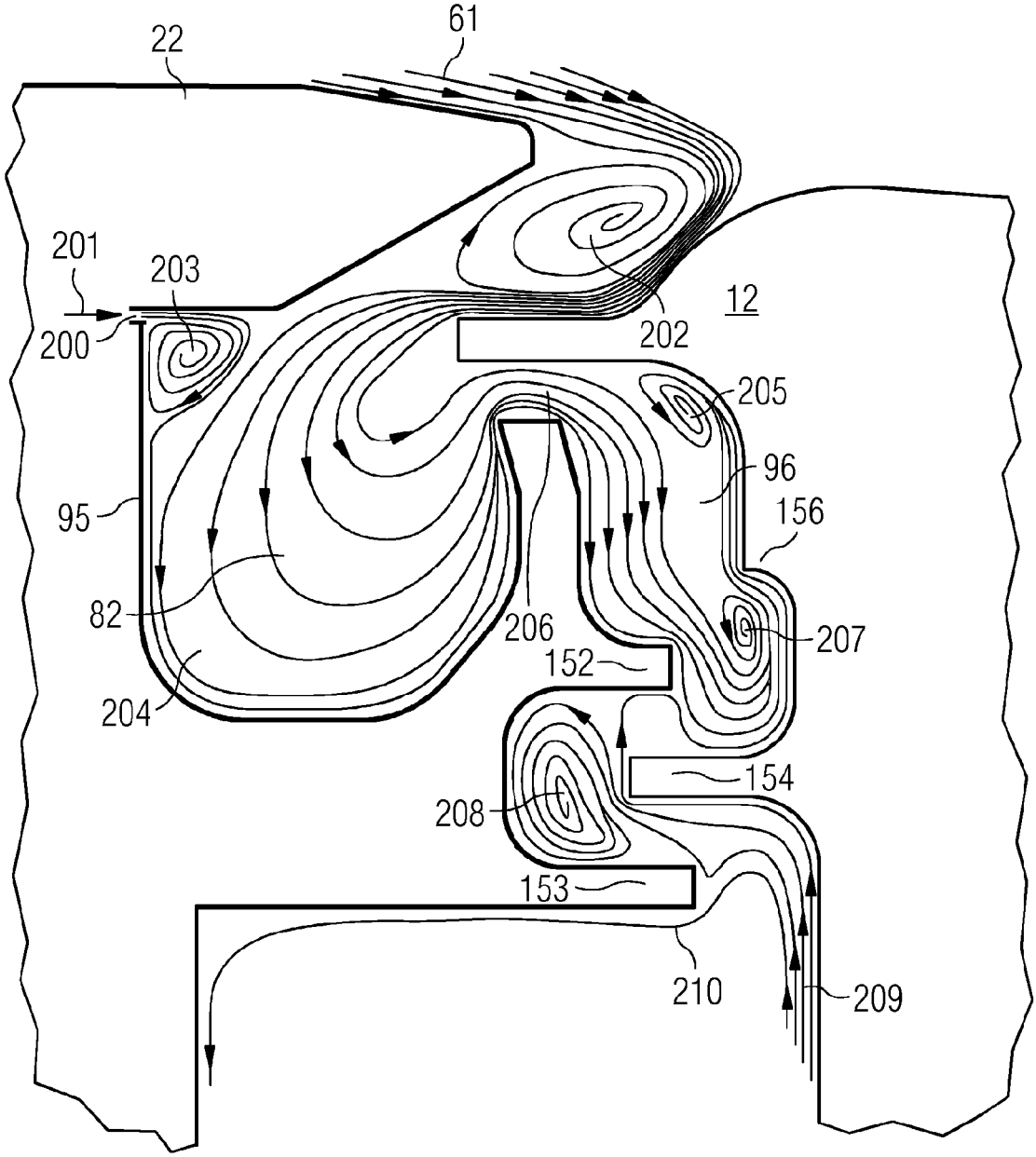
FIG. 6: shows schematically a fluid flow at a section of a turbine arrangement according to an embodiment of the invention.

In FIG. 6 now a slightly modified cross section of FIG. 4F is shown. In that cross section the fluid flow of the hot working fluid and the cool sealing fluid is shown for a specific mode of operation at a specific circumferential position. A further cooling fluid inlet 200 as fluid injector is shown as being located underneath of the inner vane platform 22 of the vane 21. "Inlet" in this respect means inlet of fluid into the cavity. It could also be considered an outlet within a stator wall to release cooling fluid, e.g. previously used to cool parts of the vane.

The cooling fluid inlet 200 may particularly be located in the axial stator surface 95 and preferably immediately underneath the inner vane platform 22. This cooling fluid inlet 200 allows an ingress 201 of cooling fluid such that it provides a film cooling cushion of cooling air on the stator surfaces such that hot working fluid entering the first annular cavity 82 will be guided along the stator surface separated by a film of cooling air. Just in the region of the cooling fluid inlet 200 a local turbulence 203 may be present which keeps the hot fluid away from the axial stator surface 95. Only one cooling fluid inlet 200 is shown in a cross section but a plurality of these inlets 200 may be present circumferentially.

According to the inventive concept, pressurised fluid flow 61 in the main fluid path near the inner vane platform 22 will be guided partially into the seal arrangement. Due to the surface shape of the inner blade platform 12 a cylindrical revolving fluid turbulence 202 is generated within or near the first annular seal passage 101. A fraction of the hot air will continue to travel along the outward facing surface of the inner blade platform 12 in axial backwards direction via the first annular seal passage 101 into the first annular cavity 82. In there, supported by the form of the first annular cavity 82 walls and the injected cooling air (201) the entering hot fluid will broaden its flow front and will be guided (204) to the first annular cavities side of the second annular seal passage 102. Hot fluid will pass (206) the second annular seal passage 102 via the tip of the radial flange 151 and will enter the second annular cavity 96. The hot fluid then will pass along another surface of the radial flange 151 and will be further guided via the first axial flange 152 to the third annular seal passage 103.

In parallel to this flow, cool sealing fluid will be guided radially outward (209) along the rotor disc surface 93. This sealing fluid will pass the second axial flange 153 of the stator and then will be guided in the negative axial direction due to the surface shape of the rotor and the presence of the radially oriented rotor flange 154. A small fraction (210) of the sealing fluid may not enter further into the third annular seal passage 103 but will be guided along the stator faces delimiting hollow space 90 on stator side.

The sealing fluid which has entered a first section of the third annular seal passage 103 will enter the space 155 and, due to the shape of the stator face, will result in a cylindrical revolving fluid turbulence 208 blocking essentially the third annular seal passage 103 for opposite hot fluid. A minor fraction of the sealing fluid may be guided further along the first axial flange 152 to a further section of the third annular seal passage 103 in which this remaining sealing fluid and the hot fluid will pass from the second annular cavity 96 will mix via a cylindrical revolving fluid turbulence 207 within this section of the third annular seal passage 103. This cylindrical revolving fluid turbulence 207—which in fact is in form of an annular cylinder—is generated with support of the step 156 on the rotor surface.

A part of the fluid is also guided along rotor surfaces, passing the step 156 and travelling further along the radial rotor surface that is a boundary to the second annular cavity 96 in direction of the underside of the inner blade platform 12. In a region in which the radial rotor surface merges to an axial rotor surface—the inwards facing surface 94 of cylindrical rotor wall 14—a further cylindrical revolving fluid turbulence 205 is created.

This figure shows the operation of the rim seal in an exemplary mode of operation. Hot fluid can only enter the rim seal but can typically not completely pass through the rim seal. The same is true for the sealing fluid that can only enter the rim seal from the other direction but can typically not completely pass the rim seal.

This sealing effect is supported by the first annular cavity 82 and the second annular cavity 96 and the first annular seal passage 101, the second annular seal passage 102, and the third annular seal passage 103, all in their specific configurations as explained in relation to the different figures.

It has to be noted that the figures do only show a section along the rotor axis. The fluid flow may also have circumferential components that are not properly shown in the figures.

Furthermore it has to be noted that the "cylindrical" stator wall may be generally axisymmetric. It may deviate from a perfect cylinder shape, e.g. being slightly angled with a major expanse I axial direction. The same applies to the "cylindrical" rotor wall.

It also has been noted that almost all components discussed are annular, even though this can not be seen in a sectional view and even if may not explicitly be mentioned in the foregoing explanation.

The invention claimed is:

1. A turbine arrangement comprising:

a rotor that rotates about a rotor axis (x) and comprises a plurality of rotor blade segments extending radially outward, each rotor blade segment comprises an aerofoil and a radially inner blade platform;

a stator surrounding the rotor so as to form an annular flow path for a pressurised working fluid, the stator comprises a plurality of guide vane segments disposed adjacent the plurality of rotor blades, the plurality of guide vane segments extending radially inward, each guide vane segment comprising an aerofoil and a radially inner vane platform, the stator further comprising a cylindrical stator wall coaxially aligned to the rotor axis (x) and an annular stator wall arranged on a mid section of an outer surface of the cylindrical stator wall;

a seal arrangement comprising a trailing edge of the inner vane platform, a leading edge of the inner blade platform and a first annular cavity and a second annular cavity, wherein the first annular cavity is defined at least by the trailing edge of the inner vane platform, a first part of the cylindrical stator wall and the annular stator wall, the second annular cavity is defined at least by the leading edge of the inner blade platform, a second part of the cylindrical stator wall and the annular stator wall, the first annular cavity is in fluid communication with the annular flow path via a first annular seal passage, the first annular cavity is separated from the second annular cavity via the annular stator wall, the first annular cavity is in fluid communication with the second annular cavity via a second annular seal passage between a rim of the annular stator wall and the leading edge of the inner blade platform, the second annular cavity is in fluid communication with a hollow space for providing sealing fluid via a third annular seal passage;

wherein the second annular cavity is defined furthermore by a substantially radially oriented ring surface of the rotor being substantially parallel to the annular stator wall; and wherein the second annular cavity further comprises a substantially axially oriented flange of the rotor, wherein the third annular seal passage is formed by an axial edge of the cylindrical stator wall and the flange; and wherein the flange of the rotor having a radial distance (D1) to the rotor axis (x) greater than a radial distance (D2) of the cylindrical stator wall to the rotor axis (x).

2. The turbine arrangement according to claim 1, wherein the leading edge of the inner blade platform comprises a cylindrical rotor wall at its leading end.

3. The turbine arrangement according to claim 2, wherein the cylindrical rotor wall has a substantially unmodified radial width over its axial length.

4. The turbine arrangement according to claim 2, wherein the second annular seal passage is formed by a most leading end of the cylindrical rotor wall and the rim of the annular stator wall.

5. The turbine arrangement according to claim 1, wherein the leading edge of the inner blade platform comprises a continuous convex curvature surface facing the flow path downstream of the cylindrical rotor wall.

6. The turbine arrangement according to claim 1, wherein the annular stator wall is arranged perpendicularly to the cylindrical stator wall.

7. The turbine arrangement according to claim 1, wherein the annular stator wall comprises a first section and a second section, wherein the first section is arranged perpendicularly to the cylindrical stator wall and the second section is inclined or curved in respect to the first section.

8. The turbine arrangement according to claim 1, wherein the flange of the rotor comprises a radial distance (D3) to the rotor axis (x) less than the radial distance (D2) of the cylindrical stator wall to the rotor axis (x).

9. The turbine arrangement according to claim 1, wherein the third annular seal passage comprises an axially oriented annular axial passage and a second radially oriented radial passage, the axial passage delimited by a shell surface of the cylindrical stator wall and a radially facing surface of a substantially axially oriented flange of the rotor or a first flange of the rotor, the radial passage delimited by a ring surface of the cylindrical stator wall and an axially facing surface of the rotor.

10. The turbine arrangement according to claim 2, wherein the cylindrical rotor wall has a radially outwards facing concave surface with a width at its lip end greater than a width at another axial location of the cylindrical rotor wall.

11. The turbine arrangement according to claim 7, wherein the second section is inclined or curved in direction of the first annular cavity.

12. A turbine arrangement comprising:

a rotor that rotates about a rotor axis (x) and comprises a plurality of rotor blade segments extending radially outward, each rotor blade segment comprises an aerofoil and a radially inner blade platform;

a stator surrounding the rotor so as to form an annular flow path for a pressurized working fluid, the stator comprises a plurality of guide vane segments disposed adjacent the plurality of rotor blades, the plurality of guide vane segments extending radially inward, each guide vane segment comprising an aerofoil and a radially inner vane platform, the stator further comprising a cylindrical stator wall coaxially aligned to the rotor axis (x) and an annular stator wall arranged on a mid section of an outer surface of the cylindrical stator wall;

a seal arrangement comprising a trailing edge of the inner vane platform, a leading edge of the inner blade platform and a first annular cavity and a second annular cavity, wherein the first annular cavity is defined at least by the trailing edge of the inner vane platform, a first part of the cylindrical stator wall and the annular stator wall, the second annular cavity is defined at least by the leading edge of the inner blade platform, a second part of the cylindrical stator wall and the annular stator wall, the first annular cavity is in fluid communication with the annular flow path via a first annular seal passage, the first annular cavity is separated from the second annular cavity via the annular stator wall, the first annular cavity is in fluid communication with the second annular cavity via a second annular seal passage between a rim of the annular stator wall and the leading edge of the inner blade platform, the second annular cavity is in fluid communication with a hollow space for providing sealing fluid via a third annular seal passage; and wherein the second annular cavity is defined furthermore by a substantially radially oriented ring surface of the rotor being substantially parallel to the annular stator wall; and wherein the second annular cavity comprises a substantially axially oriented first flange of the rotor, the rotor further comprising a substantially axially oriented second flange, wherein the first flange of the rotor comprises a radial distance (D1) to the rotor axis (x) greater than a radial distance (D2) of the cylindrical stator wall to the rotor axis (x), the second flange of the rotor comprising a radial distance (D3) to the rotor axis (x) less than the radial distance (D2) of the cylindrical stator wall to the rotor axis (x), the third annular seal passage is formed by an axial edge of the cylindrical stator wall penetrating into a space between the first flange and the second flange.

* * * * *